US010991353B1

(12) United States Patent
Baker

(10) Patent No.: US 10,991,353 B1
(45) Date of Patent: Apr. 27, 2021

(54) MODULAR SINGLE-COIL PICKUP

(71) Applicant: Donald L Baker, Tulsa, OK (US)

(72) Inventor: Donald L Baker, Tulsa, OK (US)

( * ) Notice: Subject to any disclaimer, the term of this patent is extended or adjusted under 35 U.S.C. 154(b) by 0 days.

(21) Appl. No.: 16/812,870

(22) Filed: Mar. 9, 2020

Related U.S. Application Data

(63) Continuation-in-part of application No. 16/752,670, filed on Jan. 26, 2020, now Pat. No. 10,847,131, and a continuation-in-part of application No. 15/917,389, filed on Jul. 14, 2018.

(60) Provisional application No. 62/977,462, filed on Feb. 17, 2020.

(51) Int. Cl.
*G10H 3/18* (2006.01)

(52) U.S. Cl.
CPC ..... *G10H 3/181* (2013.01); *G10H 2220/461* (2013.01)

(58) Field of Classification Search
USPC ..... 84/726
See application file for complete search history.

(56) References Cited

U.S. PATENT DOCUMENTS 2,968,204 A 1/1961 Fender
3,236,930 A 2/1966 Fender
3,916,751 A 11/1975 Stich
(Continued)

*Primary Examiner* — Christopher Uhlir

(57) ABSTRACT

A modular single-coil electromagnetic stringed-instrument pickup, made to mount in replacement of a standard single-coil pickup, using the similar mounting screws and springs, has a replaceable base, core, blade pole and cover. The core unit has two flat coil forms glued to a bar magnet, which together form a trough for the coil. The outsides of the coil forms have printed circuits which form the coil end contacts and an integral electrostatic shield, with interconnect fixed after the coil is wound, so that the core unit can be flipped to change the magnetic polarity of the pickup, and thus the string vibration signal, while maintaining a humbucking pair circuit with equivalent pickup. The base, which can be either non-magnetic or ferro-magnetic material in different shapes and configurations to shape the magnetic field, contains three conductive index pins, which both make contact with the core unit contacts, and transmit string signals to any circuit or electrical contacts on the bottom of the base. The bottom of the base can be endowed with printed circuits, either on the base itself, or in flexible printed circuit soldered to the index pins.

An elastomer shim sits between the core unit and base to give support to the core and microphonic damping. The vertical blade pole sits on top of the core unit, embedded in a non-conductive, non-magnetic horizontal support plate, is held in place by the cover, and separate elastomer shims. The shim between the blade and core unit has a section directly under the blade filled with magnetic material to transmit the magnetic field from the magnet to the blade. The blade pole can be formed, ground or filed to different heights and shapes under the strings, so as to correct for signal strength or to affect the harmonic content of the string signal directly. By trading out the core, base and blade for different types, a wide variety of tonal characters can result, imitating several other types of pickups, as well as providing upgrades from passive pickups to those with active circuits on the base.

20 Claims, 10 Drawing Sheets

© 2020 don baker dba android originals LC

(56) References Cited

U.S. PATENT DOCUMENTS

| | | | | | |
|---|---|---|---|---|---|
| 4,211,139 | A * | 7/1980 | Murakami | G10H 3/185 | |
| | | | | 84/731 | |
| 4,220,069 | A | 9/1980 | Fender | | |
| 4,379,421 | A | 4/1983 | Nunan | | |
| 5,292,998 | A | 3/1994 | Knapp | | |
| 5,525,750 | A | 6/1996 | Beller | | |
| 5,610,357 | A | 3/1997 | Frank-Braun | | |
| 6,111,184 | A * | 8/2000 | Cloud | G10H 3/182 | |
| | | | | 84/723 | |
| 8,853,517 | B1 * | 10/2014 | Dixon | G10H 3/181 | |
| | | | | 84/726 | |
| 9,401,134 | B2 | 7/2016 | Baker | | |
| 9,514,726 | B2 * | 12/2016 | Palmieri, III | G10H 3/181 | |
| 10,002,599 | B1 * | 6/2018 | Wolf | G10H 3/183 | |
| 10,217,450 | B2 | 2/2019 | Baker | | |
| 10,380,986 | B2 | 8/2019 | Baker | | |
| 10,607,588 | B2 * | 3/2020 | Berg | G10H 3/181 | |

* cited by examiner

Prior Art

© 2020 don baker dba android originals LC

© 2020 don baker dba android originals LC

© 2020 don baker dba android originals LC

© 2020 don baker dba android originals LC

© 2020 don baker dba android originals LC

© 2020 don baker dba android originals LC

© 2020 don baker dba android originals LC

© 2020 don baker dba android originals LC

© 2020 don baker dba android originals LC

© 2020 don baker dba android originals LC

MODULAR SINGLE-COIL PICKUP

This application claims the benefit of precedence of the following, by continuation in part of U.S. Non-Provisional patent application Ser. No. 15/917,389 (Baker, 2018 Jul. 14) and 16/752,670 (Baker, 2020 Jan. 26), as well as the Provisional Patent Application 62/977,462 (Baker, 17 Feb. 2020); by this inventor, Donald L. Baker dba android originals LC, Tulsa Okla. USA

COPYRIGHT AUTHORIZATION

The entirety of this application, specification, claims, abstract, drawings, tables, formulae etc., is protected by copyright: © 2020 Donald L. Baker dba android originals LLC. The (copyright or mask work) owner has no objection to the facsimile reproduction by anyone of the patent document or the patent disclosure, as it appears in the Patent and Trademark Office patent file or records, but otherwise reserves all (copyright or mask work) rights whatsoever.

APPLICATION PUBLICATION DELAY

No publication delay is requested. Much of the record of this patent application will also be published on ResearchGate.net at: https://www.researchgate.net/profile/Donald_Baker2/projects

CROSS-REFERENCE TO RELATED APPLICATIONS

This application is related to and discloses additional embodiments relating to the patents and applications cited above for benefit, filed by this inventor, Donald L. Baker dba android originals LC, Tulsa Okla. USA. It is intended for use in circuits disclosed in U.S. Pat. Nos. 9,401,134, 10,217,450 and 10,380,986, and in circuits disclosed in NPPA Ser. No. 16/156,509, by this inventor, as well as in any electric guitar or piano or other stringed instrument with multiple pickups.

It means to fulfill predictions of a wider range of tonal characters for guitars and other stringed instruments, as disclosed in the textbook, Sensor Circuits and Switching for Stringed Instruments, Humbucking Pairs, Triples, Quads and Beyond, by Donald L. Baker, ~235 p., Springer-Nature, due out on Amazon.com, April 2020.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENTS REGARDING PRIOR DISCLOSURES BY THE INVENTOR OR A JOINT INVENTOR

Not Applicable

TECHNICAL FIELD

This invention describes electro-magnetic string vibration pickups, primarily used in guitars and basses, also applicable to other musical instruments with ferrous strings, such as pianos, primarily to be used in humbucking circuit arrangements in which each pickup responds equally to external electromagnetic fields, otherwise known a hum.

REFERENCES

U.S. Pat. No. 2,968,204, Fender, 1961-01-17, Electromagnetic pickup for lute-type musical instrument U.S. Pat. No. 3,236,930, Fender, 1966-02-22, Electromagnetic pickup for electrical musical instrument U.S. Pat. No. 3,916,751, Stich, 1975-11-04, Electrical pickup for a stringed musical instrument U.S. Pat. No. 4,220,069, Fender, 1980-09-02, Electromagnetic pickup for stringed musical instruments U.S. Pat. No. 4,379,421, Nunan, 1983-04-12, Electrical pickups U.S. Pat. No. 5,292,998, Knapp, 1994-03-08, Electronic guitar equipped with assymmetrical humbucking electromagnetic pickup U.S. Pat. No. 5,525,750, Beller, 1996-06-11, Humbucking pickup for electrical guitar U.S. Pat. No. 5,610,357, Frank-Braun, 1997-03-11, Stringed musical instrument pickup with two electromagnetic coil assemblies having toothed cores U.S. Pat. No. 9,401,134, Baker, 2016-07-26, Acoustic-electric stringed instrument with improved body, electric pickup placement, pickup switching and electronic circuit US NPPA Ser. No. 15/917,389, Baker, filed 2018 Jul. 14, Single-coil pickup with reversible magnet & pole sensor U.S. Pat. No. 10,217,450, Baker, 2019-02-26, Humbucking switching arrangements and methods for stringed instrument pickups U.S. Pat. No. 10,380,986, Baker, 2019-08-13, Means and methods for switching odd and even numbers of matched pickups to produce all humbucking tones US NPPA Ser. No. 16/752,670, Baker, filed 2020 Jan. 26, Modifications to a lipstick-style pickup housing and core to allow phase reversals in humbucking circuits US PPA 62/977,462, Baker, filed 2020 Feb. 17, Modular single-coil pickup Baker, Donald L., 2020, Sensor Circuits and Switching for Stringed Instruments, humbucking pairs, triples, quads and beyond, available early 2020, © Springer Nature Switzerland AG 2020, ISBN 978-3-030-23123-1

BACKGROUND AND PRIOR ART, INCLUDING PROBLEMS TO BE RESOLVED

Fender (U.S. Pat. No. 2,968,204, 1961 & U.S. Pat. No. 3,236,930, 1966) invented some of the first single-coil pickups that look much like modern types. They differ primarily in that they mount directly to the body of an electric guitar, instead of being mounted with springs and screws to the pick guard. Some writers state that Fender Musical Instruments provided single-coil pickups with round poles of staggered height under the strings to produce the same effect in 3-coil Stratocasters until about 1974, then dropped them for a number of years, then brought them back. This inventor could not find the applicable patent(s). Stich (U.S. Pat. No. 3,916,751, 1975) and Fender (U.S. Pat. No. 4,220,069, 1980) invented some of the first pickups with screw-adjustable poles to equalize the real and perceived strength of string signals for different strings. Knapp (U.S. Pat. No. 5,292,998, 1994) and Beller (U.S. Pat. No. 5,525,750, 1996) used blade poles instead of round poles. Frank-Braun (U.S. Pat. No. 5,610,357, 1997) used blade poles with in a humbucking pickup with one blade varying in height across the strings instead of staggering round poles.

Beller (U.S. Pat. No. 5,525,750, 1996, FIG. 9) shows a set of blade poles in a two-coil humbucking pickup modified to accept screw-adjustable pole pieces. Note that the coil forms required modification to pass the screws and that the blades do not fully enclose the screw threads, which further distinguishes it from this invention. Also Beller's pickup is a two-coil pickup with a single shared magnet, not a single-coil pickup. Reversing either both the coils or the just magnet could not affect its humbucking nature, and any inversion of the string signal phase could be more easily achieved by simply reversing the coil connections outside the pickup. This has little or no correspondence to a single-coil pickup with a blade pole module entire separate of the coil and magnet. And since the Beller's blades are likely to be potted or glued in place to avoid microphonics, it is clear that they are not intended to be easily changed out and replaced.

To this inventor's knowledge, there is no fully modular pickup of this type, and beyond the inventor's own prior art, only one in other prior art (Nunan, U.S. Pat. No. 4,379,421, 1983) where the magnetic polarity of the pickup is intended to be reversed with respect to the strings, after manufacture. However, Nunan's pickup mounting structures are rather flimsy, and because the whole pickup can be inverted under the strings, it does not automatically provide for reversing the coil connections when the coil is reversed under the strings. This would make any pickup circuit in which it is originally humbucking into non-humbucking.

In US NPPA Ser. No. 15/917,389 (Baker, 2018), the rectangular magnet under the coil in a modified single-coil pickup can be slid out of the lower pickup structure, reversed and reinserted. Since the coil does not invert under the strings with the magnet, if it starts in a humbucking circuit, the remains in a humbucking circuit; only the string signal from that pickup is inverted. The magnet under the coil can be of any type that works: ceramic, alnico, rare earth or iron-chrome-cobalt. Although the ferro-magnetic poles in this pickup can clearly be staggered, or even adjustable with screws, this NPPA did not specify staggered or adjustable poles.

In a common, generic lipstick-style pickup, the pickup core inside the housing similar to Nunan's in that is has a coil wound on a magnet with top and bottom plates defining the vertical limits of the coil. When this kind of pickup is disassembled, the core can be inverted and slipped back into the housing, reversing both the coil and the magnet under the strings. So it has the same problem; if the coil contacts are not reversed by other means, any previous humbucking nature of the pickup circuit is disturbed.

In US NPPA Ser. No. 16/752,670 (Baker, 2020), the invention solves this problem using plated electrical contacts on the upper and lower coil form, with 180-degree symmetry and mating contacts within the coil housing, so that when the core is inverted and reinserted, the coil connections automatically reverse, maintaining any humbucking circuit in which it resides. But this approach to contacts, housing and access to the core required that the pickup be mounted on a lowered guitar body surface, and that the housing be significantly longer than a standard single-coil pickup. Therefore it could not be mounted in the pickguard as a replacement for standard single-coil pickups.

Baker (US PPA 62/977,462, 2020) sought to adapt the reversible core of US NPPA Ser. No. 16/752,670 to fit into a pickup cover the same size and shape as a standard single-coil pickup, so that it could be mounted in a standard single-coil pickup hole in any 3-coil guitar pick guard.

Technical Problems Found and Resolved

Most if not all pickups made are designed and configured just once, at the time of manufacture. It may be possible to change the height of adjustable pole pieces, or in many fewer cases to disassemble the pickup and reverse the magnet or magnets. Even then, reversing the magnet in a dual-coil humbucking pickup does little more than one can do by simply reversing the leads. Only single-coil pickups in humbucking circuits will show significant benefits from reversing the magnet, and there are no known single-coil pickups on the market which allow that.

In seeking to adapt the reversible coil-magnet core in NPPA 16/752,670 to fit into a pickup cover the same shape and size of a standard single-coil pickup, so that it can replace one in the pickguard of a 3-coil electric guitar, Baker found that it made sense to design a modular pickup with four replaceable and upgradeable parts, or modules: a) a coil-magnet core with electrical contacts and an integral electrostatic shield on the coil form plates; b) a blade-style pole that could be easily filed or ground down to stagger its height below the strings in whatever manner the musician desires; c) a pickup cover of standard size, with a slot in the top to pass the blade; and d) a pickup base with indexing pins to both hold the core steady on the base and to pass the ground and signal connections to the rest of the guitar. On further reflection, the blade-style pole can also be made into round poles above the its base, which can be flat or staggered in height, or drilled and tapped for adjustable screw pole extentions.

In this manner, one need not buy an entirely new pickup to switch to another type of pickup or tone. A replacement blade can be ground to another staggering pattern. No only can the core be inverted to invert the string signal, while maintaining a humbucking circuit, the core can be switched out to try different magnets and coil winding techniques. The base can be switched out to try different types of non-magnetic or ferro-magnetic bases, to approximate other pickup types, such as P-90s. Each of these changes beyond inverting the core can affect humbucking, because of different magnetic paths for hum with different magnetic parts. So a change of one or two pickups can help to decide whether or not to change the whole set, to maintain humbucking. And it remains to be determined if these changes can be made while maintaining the characteristics of the hum magnetic circuit.

In the writing and reviewing of a textbook on pickup circuits (Baker, 2020, Sensor Circuits and Switching for Stringed Instruments, Springer-Nature), Baker found that most of the difference in tone between switched pickup circuits can be assigned to the high-frequency loading of following components, such as the tone capacitor, tone pot and volume pot, on the lumped pickup circuit impedance. In theory, if the other components are removed, or isolated on the output side of a high-input-impedance preamplifier after the switches, many of the switched circuits will have the same tone. Then the only differences remaining will come from different relative contributions of each pickup under the strings to the output, or from moving pickups about the circuit, thus changing their relative outputs, or from reversing the string signal phase of the pickup. In a humbucking circuit, merely switching the pickup connections to switch the string signal phase also destroys the humbucking. But reversing the field of the magnet does not.

Currently, the theoretical count of different circuit equations with different relative outputs for J=2, 3, 4 & 5 matched single-coil pickups is 1, 1, 3 and 8, respectively. The math and count of different equations has not yet been fully determined for J=6, but is on the order of 18. The number of tones available from each of those equations, due to moving pickups about the equation positions with switching, depends upon how many of the coefficients are the same, thus nullifying the move. From Table 7.7 in Baker (Sensor Circuits, 2020), the number of humbucking circuits including placing pickups in different circuit equation positions for J=2 to 5 pickups is 1, 3, 19 and 365.

If the magnetic field can be reversed, then for J number of pickups, there are $2^{J-1}$ number of overlapping tonal sets, due to reversing string signal phases in humbucking circuits. For J=2, 3, 4 & 5, there are 2, 4, 8 and 16 different possible humbucking tonal characters from reversing magnets. Non-humbucking circuits are not counted here. From Table 7.13 in Baker (Sensor Circuits, 2020), the number of possible tones from different contributions to output, including reversing single-coil magnets, is 2, 12, 52 and 2720. So for a 3-coil guitar with 3 matched single-coil pickups, there are 6 total switched humbucking circuits of 2 and 3 pickups, and 4 different tonal characters from reversing magnets, sharing a total of 12 different tones. For 3 pickups, reversing magnetic fields doubles the number of available tones.

The fly in the ointment—the tones tend to bunch together at the warm end, where they will likely be less distinct. Partly due to string signal phase inversions, this approach has a much wider range of tones, more than doubling in number above 3 pickups, but some of the tones may sound alike. This may not be as much of a problem in pianos, where the pickups can be spread over a wider portion of the strings.

SUMMARY OF INVENTION

A modular single-coil electromagnetic stringed-instrument pickup, made to mount in replacement of a standard single-coil pickup, using the similar mounting screws and springs, has a replaceable base, core, blade pole and cover. The core unit has two flat coil forms, made the same way as a single inventory part, and glued to a bar-like magnet, which together form a trough for the coil. The outsides of the coil forms have printed circuits which form the coil end contacts and an integral electrostatic shield, with interconnects between the forms fixed after the coil is wound. Thus, the core unit can be flipped to change the magnetic polarity of the pickup, while maintaining a humbucking pair circuit with an equivalent pickup. The base, which can be either non-magnetic or ferro-magnetic material in different shapes and configurations to shape the magnetic field, contains three conductive index pins, which both help hold the core module fixed with respect to the base and make contact with the core unit contacts, and transmit string signals to any circuit or electrical contacts on the bottom of the base. The bottom of the base can be endowed with printed circuits, either on the base itself, or in flexible printed circuit soldered to the index pins.

An elastomer shim sits between the core unit and base to give support to the core and microphonic damping. The vertical blade pole sits on top of the core unit, embedded in a non-conductive, non-magnetic horizontal support plate, is held in place by the cover, and separate elastomer shims. The shim between the blade and core unit has a section directly under the blade filled with magnetic material to transmit the magnetic field from the magnet to the blade. A third elastomer shim sits on top of the blade support, between it and the inside top of the cover, with a central hole to pass the blade, to dampen movement between the modules. The blade pole can be formed, ground or filed to different heights and shapes under the strings, so as to correct for signal strength or to affect the harmonic content of the string signal directly. Or the blade can be formed with separate round poles above the blade support, to mimic standard 3-coil pickups, or hold screw-adjustable pole extensions for manual staggering of the poles. By trading out the core, base and blade for different types, a wide variety of tonal characters can result, imitating several other types of pickups, as well as providing upgrades from passive pickups to those with active circuits on the base.

BRIEF DESCRIPTION OF THE DRAWINGS

FIG. 1 shows FIG. 2 from U.S. Pat. No. 2,968,204 (Fender, 1961), and FIG. 2 shows FIG. 2 from U.S. Pat. No. 3,236,930 (Fender, 1966).

FIG. 10A shows first the end of the base in FIG. 7C, while

FIG. 13A shows the simulated fields of the basic magnet, blade pole and rubberized magnetic interconnect pad between them. FIG. 13B shows how the fields degrades when the whole of the elastomer pad between the rigid blade support and core is magnetic. FIG. 13C shows the fields when the bottom elastomer pad between the core and base is magnetic. FIG. 13D shows the fields when both the base and lower elastomer pad are ferro-magnetic. FIG. 13E shows a wider ferro-magnetic base. FIG. 13F shows a thinner and lighter ferro-magnetic base with "wings" to shape the field similar to FIG. 13E.

DESCRIPTION OF THE INVENTION BY MEANS OF DRAWINGS

Figure 1:
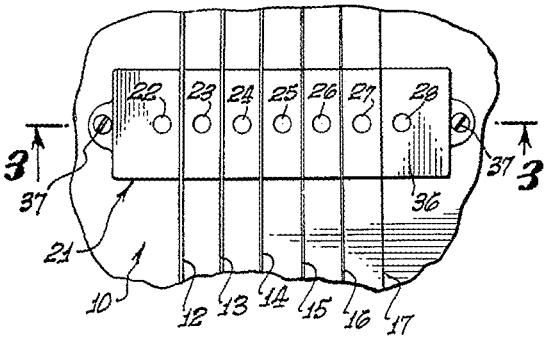
FIG. 1 Prior Art
FIGS. 1 & 2 show early versions of the iconic Fender single-coil Strat pickup with magnetic poles.
Figure 2:
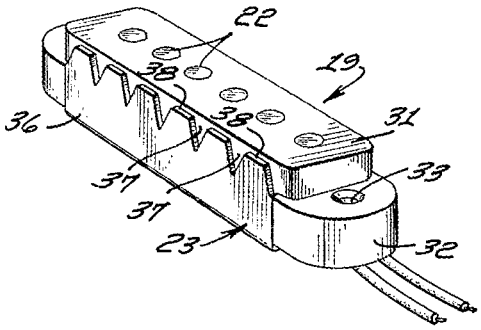
FIG. 2 Prior Art

FIG. 1 (U.S. Pat. No. 2,968,204, Fender, 1961) and FIG. 2 (U.S. Pat. No. 3,236,930, Fender, 1966) show some of the earliest examples of the single-coil guitar pickup with magnetic pole pieces in a single coil, mounted in a long frame with mounting ears for attachment to a guitar. The numeric identifiers come from those patents and are not explained here.

Figure 3:
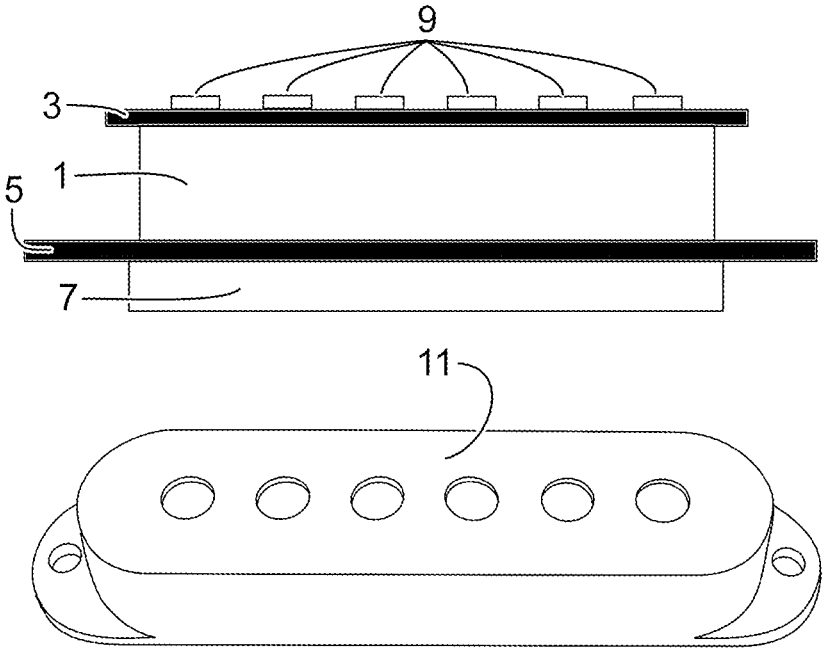
FIG. 3 shows a tracing of a modern generic single-coil pickup with ferro-magnetic poles n on top of a rectangular ceramic pickup magnet (7).

FIG. 3, derived from a photograph, shows a generic single-coil pickup with a coil (1), wound between coil form plates (3&5), around steel poles (9), with a ceramic magnet (7) underneath and a separate cover (11).

Figure 4:
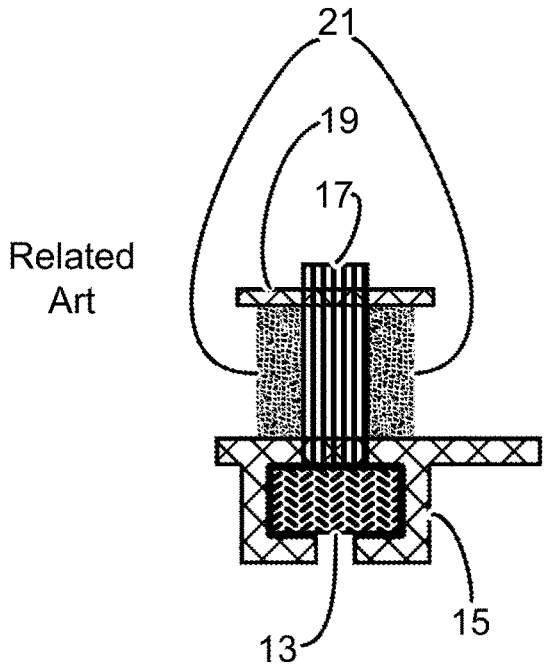
FIG. 4 shows related art, the single-coil pickup from NPPA 15/917,389, with a removable rectangular magnet (13) that slides into a box (15) in the lower structure of the pickup.

FIG. 4 shows a similar pickup to FIG. 3, from U.S. NPPA Ser. No. 15/917,389 (Baker, 2018). It has similar poles (17), upper coil form (19) and coil (21), but with a removable and reversible magnet (13) in a modified lower coil form (15).

Figure 5:
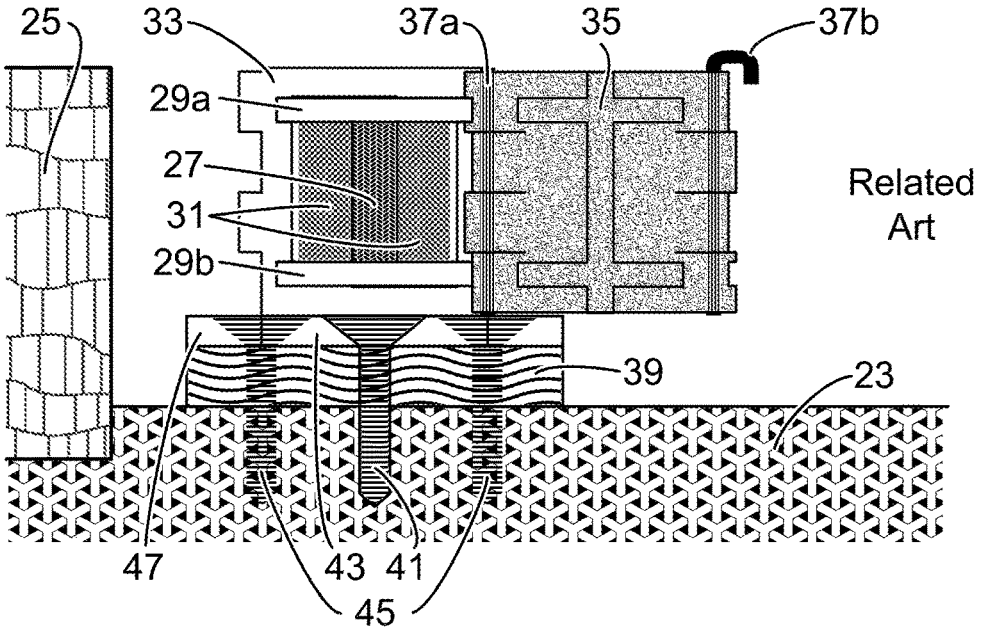
FIG. 5 shows the musician's end view of the related art pickup in NPPA Ser. No. 16/752,670, with a hinged housing end cap and a removable coil-magnet core.

FIG. 5 shows a much different single-coil pickup from U.S. NPPA Ser. No. 16/753,670 (Baker, 2020), with a removable core unit (27—magnet, 29*ab*—coil forms, 31—coil) which can be flipped over in housing (33) to change the polarity of the magnetic field at the strings, which changes the string signal phase, while automatically reversing the coil connections to maintain a humbucking circuit with other pickups matched to it. This figure depicts the pickup mounted on the guitar body (23) near the neck (25) on an elastomeric pad (39) with mounting screw (41) in mounting ear (43) at the near end and mounting screws (45) in mounting ear (47) at the far end. It is shown with access door (35) open on hinge pin (37*a*) with latch pin (37*b*) disconnected from housing (33).

The pickup in FIG. 5 is not only larger than the standard single-coil Strat-type pickup, but cannot be mounted in a standard pickguard plate without impeding access to the core. It also requires major modifications to common types of guitar bodies, so that it can be mounted at the proper level below the strings and still have access to the core. But the coil forms and contacts can be modified so that core fits within the boundaries of a standard pickup cover, as shown in FIG. 3 (11).

Figure 6A:
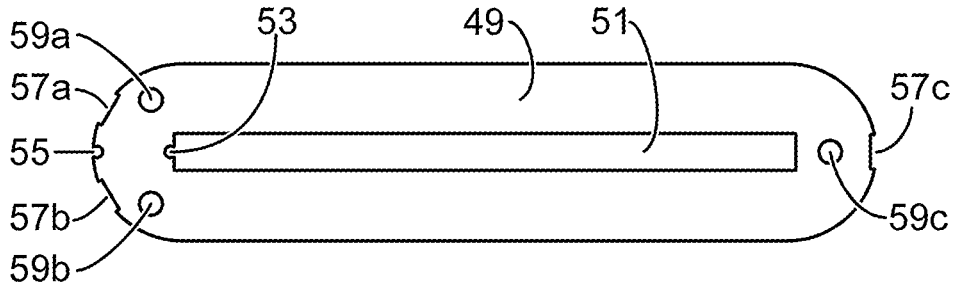
FIG. 6A Related Art
FIG. 6ABC shows details for the related art coil-magnet core from NPPA 16/752,670 modified to fit into a pickup cover/housing the size of as standard single-coil pickup cover, with electrical contacts for the coil ends, integral electrostatic shielding, and interconnects between the coil form plates.

FIG. 6ABC shows the outline and features of coil form (49) that can be used instead of (29) in FIG. 5. For clarity, FIG. 6A shows it without printed circuit conductive plating and FIG. 6B with. It has a center slot (51) for a bar magnet (51mag in FIGS. 6B & 6C). The conical depressions (59*abc*) in the surface of the form do not fully penetrate it, to accommodate index and contact pins in the pickup base (FIGS. 7, 8, 10, 11, 12).

Figure 6B:
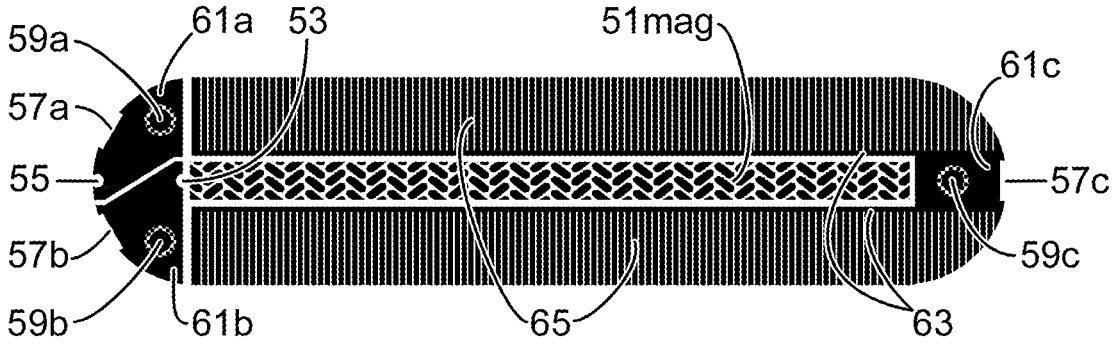
FIG. 6B Related Art

On one form and one form only, the other being only for electrical contacts when the core is reversed, the coil wire end for the inner winding is brought out through hole (53) and soldered to plated electrical contact (61*b*). The coil is wound on the magnet with commonly-used pickup magnet wire. If the magnet is either rough or metallic and conductive, a cushioning and insulating layer (not shown) should coat or wrap the magnet. It can be anything from teflon pipe tape to plastic electrical tape to smooth powder-coat. After the coil is wound on the magnet, between the forms, the outer winding end is brought out through notch (55) and soldered or otherwise connected to contact 61*a*. Note the insulating gaps between plated conductors for the contacts (61*ab*&*c*). FIG. 6B shows that the conical depressions (59*abc*) are also plated and in contact with the surrounding conductive plating. The ground contact (61*c*) connects via conductors (63) along the magnet hole (51) to a pair of comb-like electrostatic shields (65). Alternatively, the ground conductors (61) could be place anywhere in the comb shields, out to the edges of the form (49). It is also possible to run the shield combs in any direction, including horizontal in FIG. 6B, so long as the shielding does not encourage hysteresis currents induced by string signals in the coil (not shown).

Figure 6C:
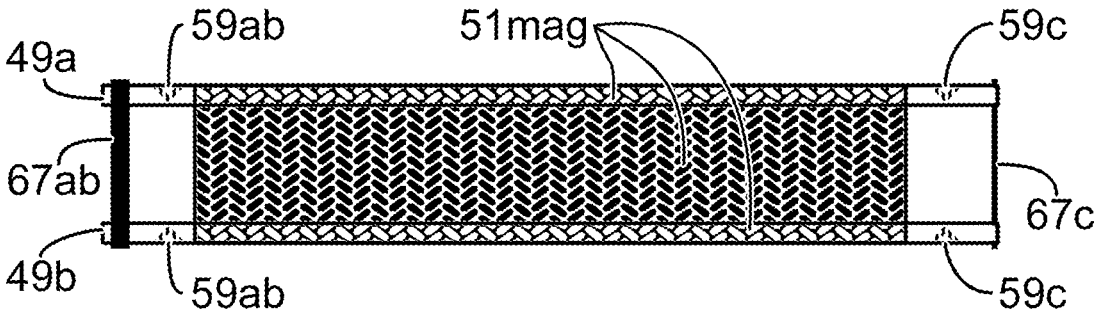
FIG. 6C Related Art

FIG. 6C shows the coil forms (49*a*, 49*b*) mounted on the magnet (51mag) with indexing/connecting conical depression s (59*ab*&*c*) and the relative positions of electrical interconnects (61*ai,bi*&*ci*) between the coil forms. Notches (57*abc*, FIG. 6B) allow electrical interconnects (61*ai*, 61*bi*, 61*ci*) to be made or soldered from the top form (49*a*) to the bottom form (49*b*), so that the whole core can be reversed with the coil still connected to contact/indexing pins in the base, but with the coil contacts reversed to maintain the same phase for any external hum signal. The notches (57*abc*) should be plated on the vertical edges of the coil forms (49*ab*) in the Figure, to facilitate soldering of the interconnects (61*ai,bi*&*ci*). They should not extend more than ⅓ to ½ the thickness of the elastomer pads (86 & 93, FIG. 7C) above or below the outer horizontal surfaces of the coil forms (49*ab*). Note that the electrical interconnects (61*ai,bi,ci*) can be installed ONLY AFTER the coil is wound. The electrical interconnects can be several embodiments, including strips of flexible printed circuit (selectively coated with an insulating layer) or fine-gauge wire. If an interconnect fails in service, it can be fixed with common 30-AWG wire-wrapping wire, or something similar.

Figure 7A:
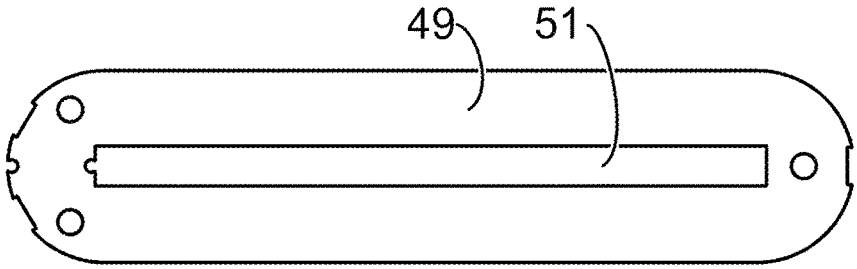
FIG. 7ABC shows the outline of the coil form plate compared to a standard-sized pickup cover modified for a blade pole, and the internal structure of the invention from the bridge side.
Figure 7B:
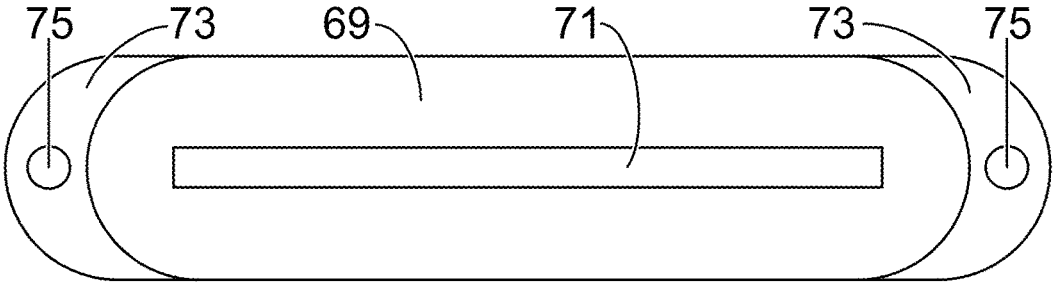
Figure 7C:
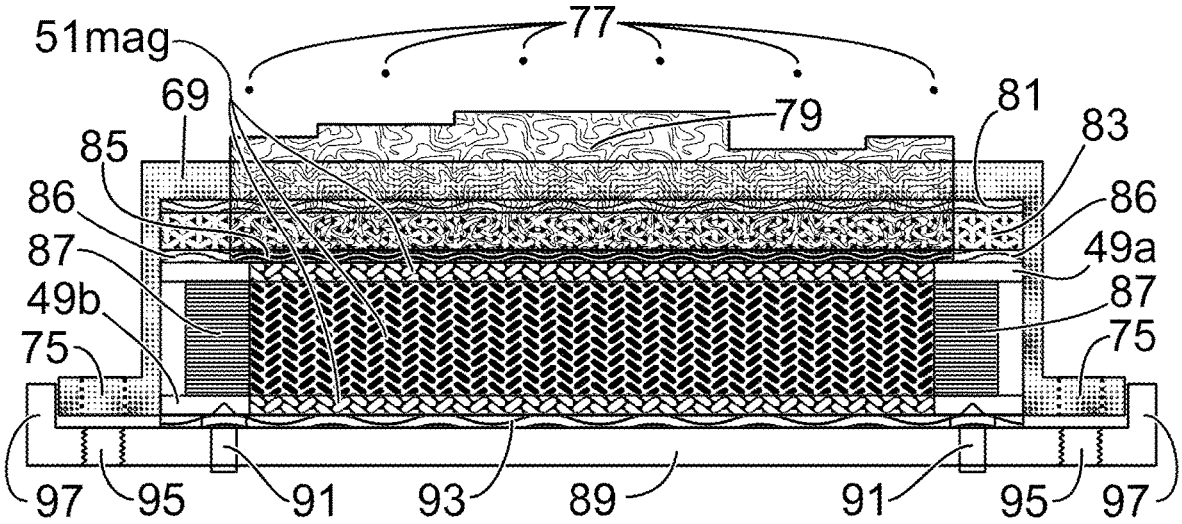

The ground interconnect (61*ci*) can be used to provide additional shielding around the body of the coil (87, FIG. 7C). In one embodiment (See FIG. 16AB&C), the interconnect is made of flexible printed circuit and is a conducting bar at the end of a long rectangular circuit, the rest of which wraps completely around the coil and tucks under all the interconnects. It can be plated either with a solid rectangular grounded conductor, or with a comb shield. In another embodiment, the ground interconnect is a solid wire to which the more usual and common copper shielding tape is grounded, and tucks under all the interconnects as well as itself for full coverage of the coil sides, without impeding insertion of the core into the cover. All parts of this shield not directly connected to the ground contacts 61*c* in notches 57*c* should have a non-conducting coating to avoid shorting to other parts.

In order for this to work with other pickups of the same type in humbucking circuits, all of the pickups have to be wound the exactly same way with the same number of turns. In this pickup, starting the coil wire soldered to one form (49*a*, FIGS. 7C, 8) and ending with it soldered to the other form (49*b*) will short out the coil through the interconnects. It must always be wound in the same direction, with the same pole of the magnet fixed to the form where the coil ends are connected. Otherwise humbucking and string signal phases cannot be consistently upheld and observed.

This modular design allows musicians to trade out one type of core for another with a different kind of magnet, such as ceramic, alnico, rare-earth or iron-chromium-cobalt, or one type of winding for another, such as close-pack or scatter-wound and potted or unpotted. It will take some experimentation in the number and type of turns to keep mix-and-match pickups working in humbucking circuits, especially with change in base material or shape.

FIG. 7ABC shows other parts of the pickup in relation to the coil form (49, FIG. 7A). FIG. 7B shows a standard-sized single-coil pickup cover (69), modified from round poles to a slot (71) to accommodate a blade pole (79, FIG. 7C) fitted into the form magnet slot (51). It has standard mounting ears (73) with standard mounting holes (75).

FIG. 7C shows the blade pole (79) under the strings (77), passing up through the cover (69), either cut or formed with "staggered" heights under the strings to adjust for different string vibration signal strengths, similar to the staggered poles of Fender Strat™ pickups before 1970 and after about 1984. This drawing is a pseudo-cross-section, where parts which surround the blade pole are shown as transparent, including an elastomer cushion, pad or shim (81) and a rigid support (83) into which the blade pole is embedded, close to the same size and shape of the coil form (49*ab*), so that it slides into the cover with a close fit. The rigid blade support can be any suitable non-conductive and non-magnetic material, including but not limited to glass-filled nylon, fiber-reinforced epoxy, or ceramic.

The blade pole can be any ferro-magnetic material, such as non-magnetized iron-chromium-cobalt alloy or chrome- or nickel-plated iron or varnished and laminated transformer steel or magnetic stainless steel, capable of passing magnetic field from the magnet (51mag) to the strings (77), or even a second magnet. It can be a composite material, such as rubberized ferrite, or steel wool compressed with epoxy or plastic, to make it easier for musicians to adjust heights under the strings to their own needs by grinding or filing. It could even be a flat blade with adjustable screw poles set into it. (See FIGS. 14AB) Or even transition from a blade bottom in the blade support (83) into round poles simulating standard 5 mm poles (FIG. 15ABC).

FIG. 7C shows a thin rubberized magnetic pad (85), making a magnetic connection between the blade pole and the magnet (51mag). A thin non-magnetic elastomer cushion (86) surrounds (85), helping to stabilize the rigid blade support (83). Therefore, the pad (81) above the blade support (83) is repeated below the blade support, but must be in two pieces, the magnetic pad (85) and the non-magnetic pad surrounding it. These pads, with the thin elastomer pad (93) below the core (49*a*, 51mag, 87—coil (not shown previously), 49*b*) provide some measure of cushion and compression to hold the pieces fixed in relation to each other, under the tension of the standard single-coil pickup mounting screws and springs (not shown). They also tend to damp out microphonics to some extent.

In FIG. 7C, the cover mounting holes (75) match up with threaded mounting holes (95) in the base (89). A crescent-shaped lip (97) in the base, mated to the ears (73) in the cover (69) helps to hold the cover in place when the pickup parts are assembled. The core sits on an elastomer pad (93), which surrounds index/connector pins (91), which mate with the conical depressions (59*abc*, FIG. 6) in the bottom coil form (49*b*) and make electrical contact with the plated coil contacts and shield ground. The electrically conductive pins (91) have conical tops to mate with the conical depressions, a wider collar (101, FIGS. 11 & 12) to seat against the base, and a longer section of smaller diameter to penetrate through the base (89) to connections or circuits (not shown) on the bottom of the base.

Figure 8:
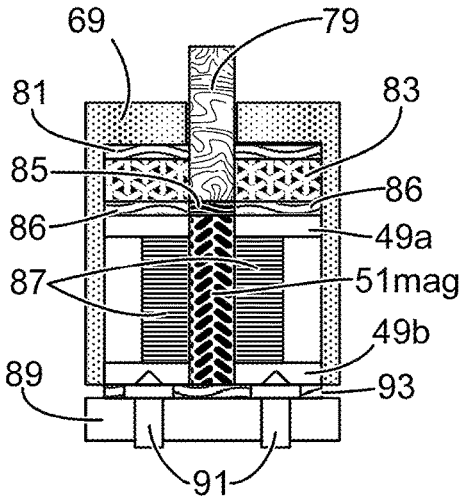
FIG. 8 shows the internal structure of the invention from one end.

FIG. 8 shows the end view of the cover, blade module, core module and base module with pins in pseudo-cross-section, with the cover (69), the blade pole (79), the top elastomer pad (81), the blade support (83), the magnetic pad (85) with the non-magnetic elastomer section (86), the top coil form (49*a*) the magnet (51mag), the coil (87), the bottom coil form (49*b*), the base (89), the bottom elastomer shim (93), and the index/connector pins (91) called out. While the blade pole (79) is shown as a single solid in the drawing, this does not preclude the use of a laminated pole to discourage induced hysteresis currents from the string vibration signal, or any other kind of composite pole, such as rubberized ferrite or ferrous-reinforced epoxy or plastic.

Figure 9A:
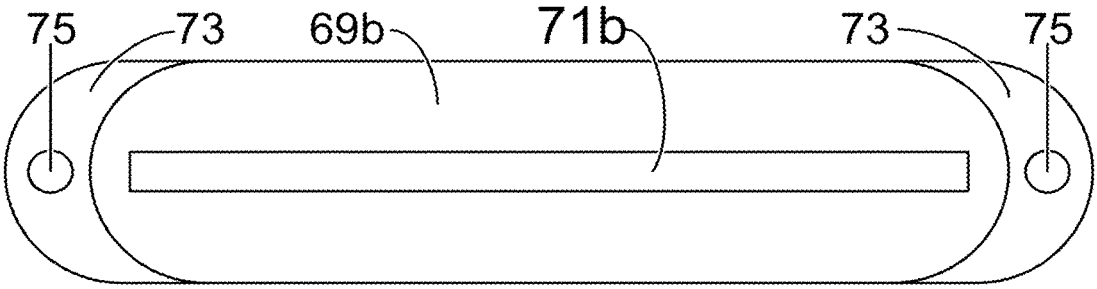
FIGS. 9A and 9B show an alternate embodiment of the cover (9A) and blade pole (9B), leaving out other parts, where the blade pole is lengthened to give each string an equal width of pole under it, and scalloped and staggered under each string to provide string signals with a theoretically higher harmonic content.

FIGS. 9A&B show a reduced number of parts, with an alternative embodiment of the cover (9A, 69*b*) with a longer slot (71*b*) to pass a longer blade pole (9B, 79*b*), which also requires a modified upper elastomer cushion (81*b*), blade support (83*b*) and magnetic pad (85*b*). In this embodiment, each string (77) sits over equal lengths of blade pole. The theory behind the circular scallops cut in the blade below each string holds that when the string vibrates in a circular manner, it stays at nearly the same distance from the pole in the arc of the scallop, tending to flatten that peak of the vibration signal, and increasing its harmonic content. But this is just a theory for now. The point being that with replaceable blade poles that can be filed to any shape, a greater number of different tonalities can be achieved.

Figure 9B:
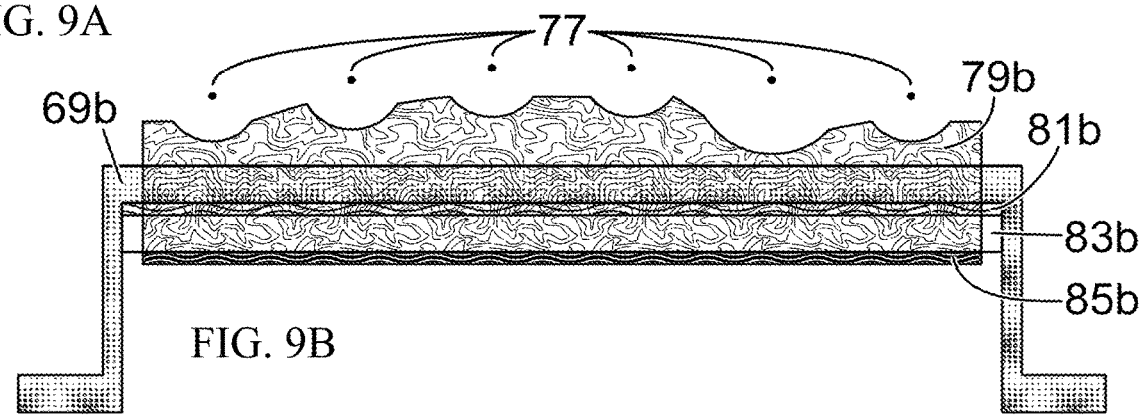
Figure 10A:
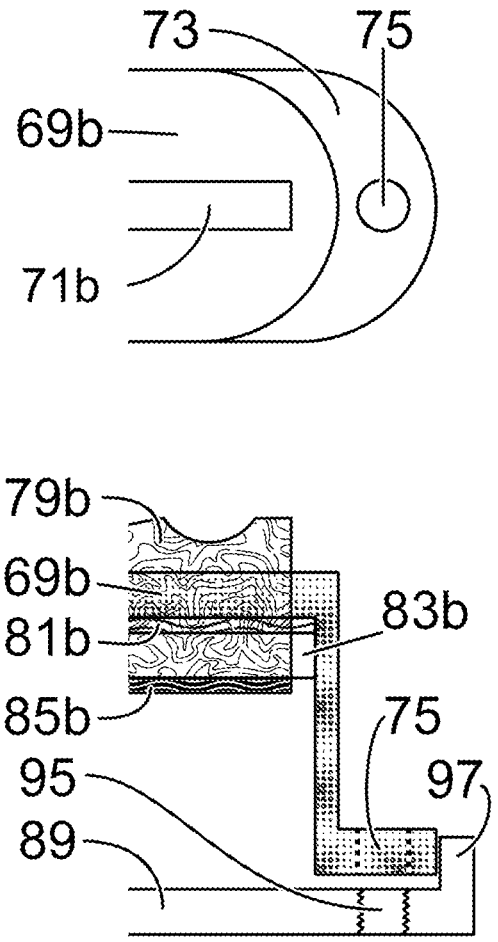
Figure 10B:
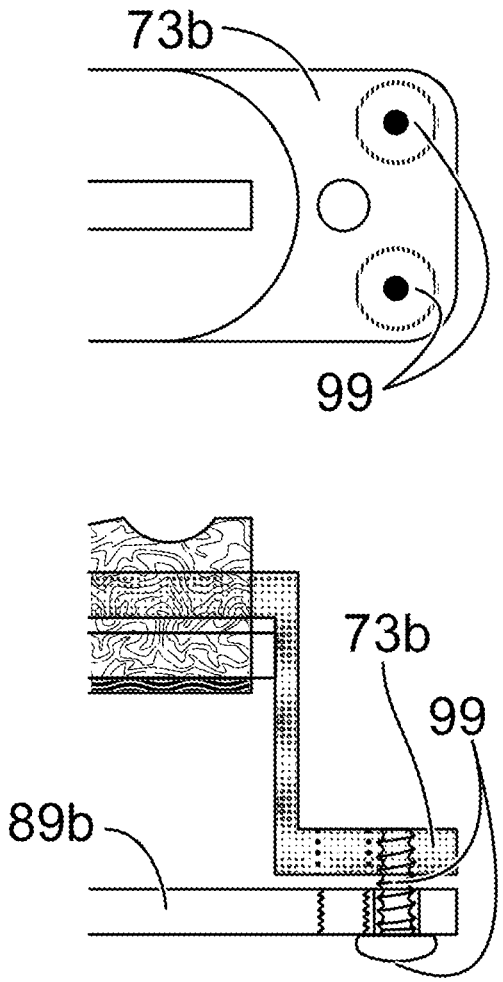
FIG. 10B shows a modified base and cover, using two screws at each end to hold the base and cover together after assembly, so that the pickup can more easily be mounted in the pickguard as a more stable whole.

FIG. 10A repeats the embodiment of the blade in FIG. 9B, and the base in FIG. 7C, for comparison to FIG. 10B. One might expect the four main parts of the pickup to be a little difficult to hold in position to each other while the pickup is being mounted on screws and springs in the pickguard. So FIG. 10B shows a better embodiment, with a longer, squared-off mounting ear (73B), and a matching modified base (89*b*) with holes for two assembly screws (99) to screw into matching threaded holes in the cover ears. With this embodiment, the pickup can be pre-assembled and handled as a single unit while being mounted in the pickguard. However, the larger mounting ears may require larger cavities to be cut into the guitar body.

Figure 11:
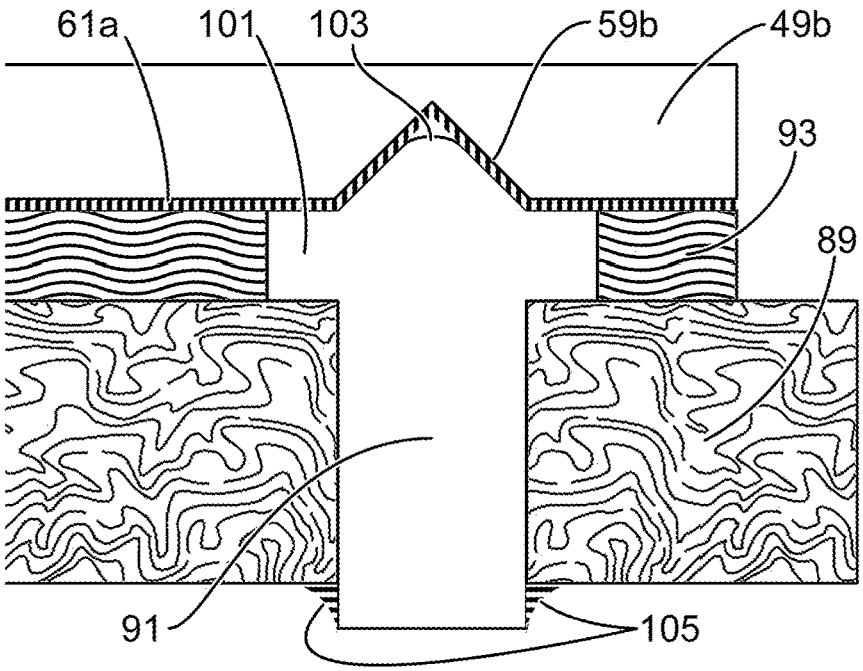
FIG. 11 shows a detail of the index/connection pin and mating coil form conical depression, with a non-magnetic pickup base. Connections outside the pickup are not shown.

FIG. 11 shows a detail of how an indexing/contact pin (91) fits into the base (89) and mates with the conical depression (59*b*) in the lower coil form (49*b*). The pin has a truncated top (103) so that it does not high-center in the conical depression. The plating (61*a*) on the underside of the coil form extends into the conical depression. The pin has a flat circular flange (101) that both connects electrically with the contact (61*a*) and keeps the pin from pushing down into the base (89). The elastomer cushion (93) surrounds the pin. In this figure, the base is non-magnetic and non-conductive, except for printed circuitry on the bottom of the base (not shown) to which the pin is soldered (105).

Figure 12:
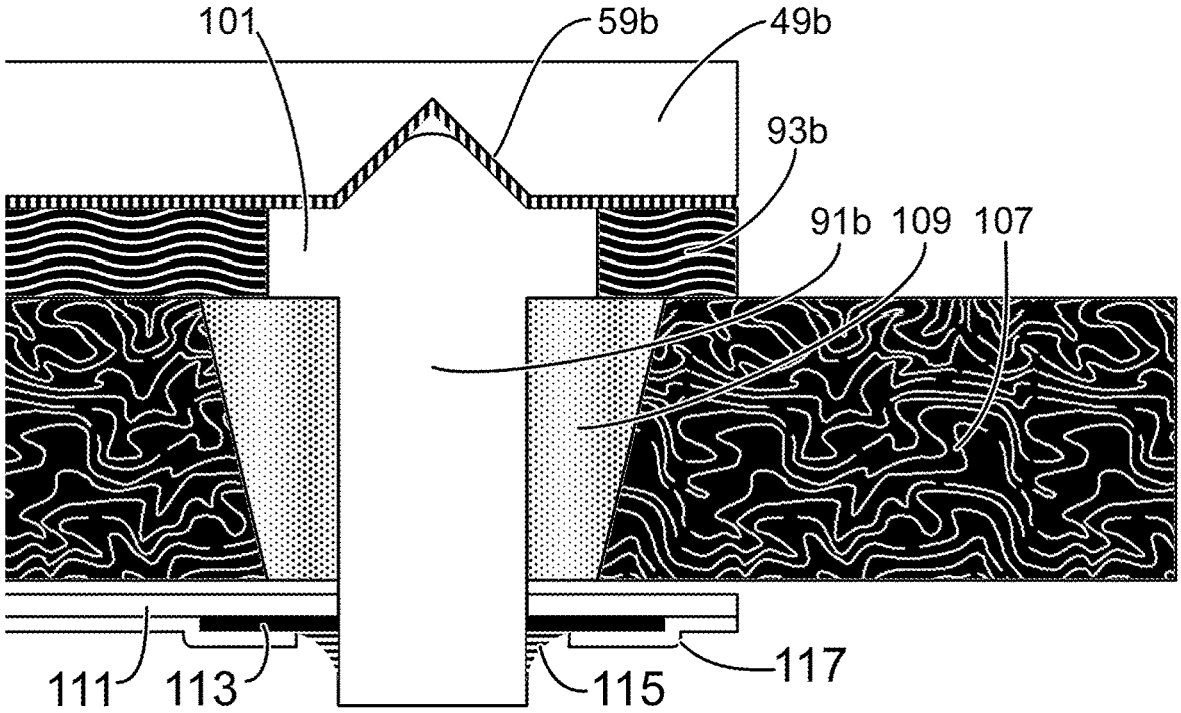
FIG. 12 shows a longer index/connection pin with an electrically insulating cone seated in a ferro-magnetic base, with the pin soldered to a flexible printed circuit mounted below the base.

In FIG. 12, the base (107) is both wider and ferromagnetic, and the elastomer pad (93*b*) is non-conductive rubberized magnetic material. The modified and longer index/contact pin (91*b*) sits not in the base directly, but in a non-conductive and non-magnetic cone (109), shaped to keep from pushing through the base. The longer pin extends beyond the base to a printed circuit with a substrate (111), metallic plating (113) for the circuit, to which the pin is soldered (115), with a conformal coating (117).

FIG. 13A-F shows different possible magnetic configurations of the pickup, with non-magnetic components omitted. The drawings have been copied directly from screen shots of an old version of the magnetic simulation software, Maxwell Student Version 3.1.04, Ansoft Corporation, Pittsburgh Pa., ansoft.com. This software simulates only in 2-D, so that the fields are calculated as if the magnetic parts are bars extending into and out of the image to infinity. They show the flux lines (119*x*) in Wb/m, the B-field (121*x*) in Tesla, all with the same the blade pole (123) made of 1008 steel, the thin magnetic pad (125*x*), and the same Ceramic 8D bar magnet (127). In all the FIG. 13 drawings, the rubberized ferrite has been simulated as a ferrite with permeability of 400 instead of 1000. The flux lines number 20 with a linear distribution, and the B-field lines number 20 with a logarithmic distribution, ranging from 0.005 Tesla to 1 Tesla. The outer B-field line in each is 0.005 T, so that the overall size and shape of the fields can be compared.

Figure 13A:
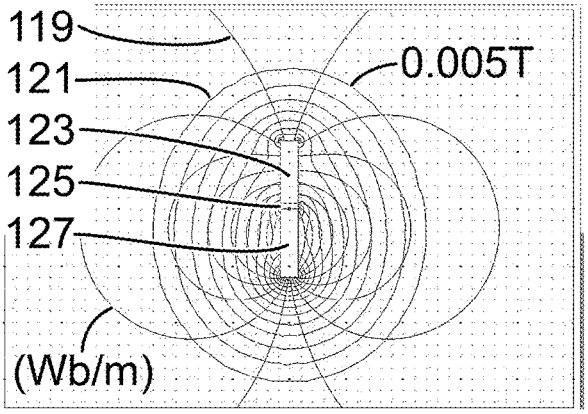
FIGS. 13A-F show 2-D magnetic field simulations of the flux lines and B-field of various configurations with the same ceramic 8D magnet and steel 1008 blade pole.
Figure 13B:
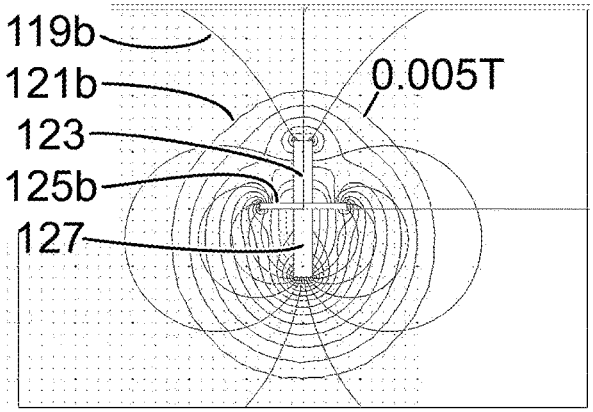
Figure 13C:
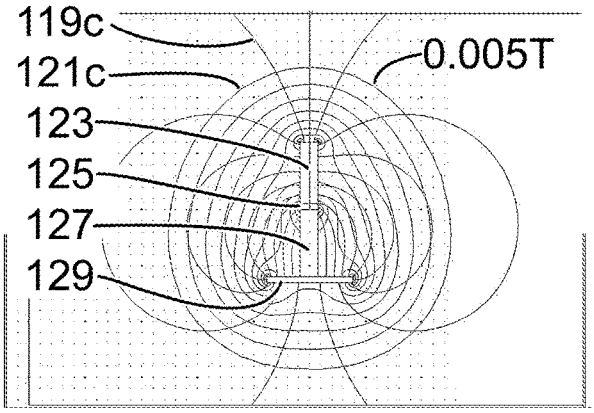
Figure 13D:
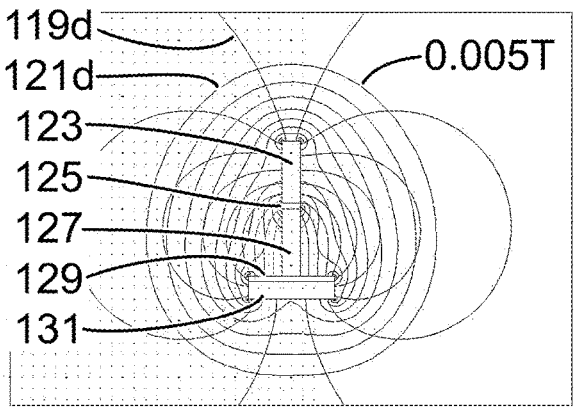
Figure 13E:
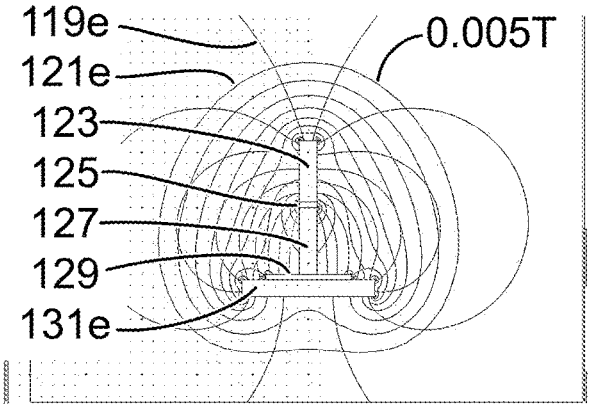
Figure 13F:
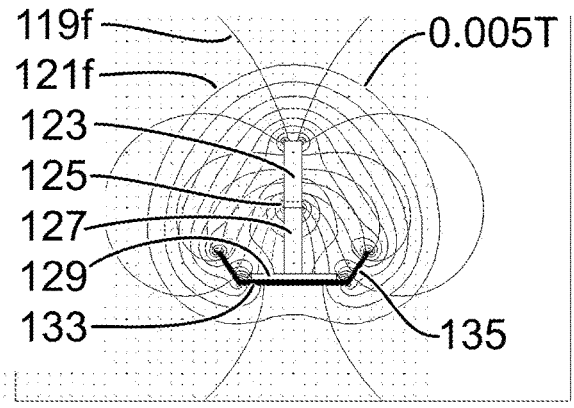

FIG. 13A has the baseline configuration, with just the blade pole, the magnetic pad and the bar magnet. FIG. 13B shows the undesirable effect of making the entire elastomer pad between the pole and magnet of magnetic material, such as rubberized ferrite. It pulls the field down, away from the strings. FIG. 13C show the effect on the field of making the bottom elastomer pad (129) out of rubberized ferrite. In FIG. 13D the base (131) is Steel 1008, a transformer steel in the model, three times thicker than the rubberized ferrite pad (129). In FIG. 13D, the steel base (131*e*) is widened. And in FIG. 13F, the base is ⅓ the thickness as in FIGS. 13D&E, but has wings bent up at about 60 degrees. This would make the base in FIG. 13F lighter than in FIG. 13E, but with similar magnetic characteristics. FIGS. 13A, C-F demonstrate the possibilities for variations in the base to shape the field and approximate the tonalities of other kinds of pickups.

TABLE 1

Comparison of magnetic field parameters in FIGS. 13A-F. The parameters are relative to those of FIG. 13A. Parameter A is the width of the 0.005T B-field line at 2 cm above the top of the magnet (127), which is about 8mm above the top of the steel blade pole (123). Parameter B is the height of the 0.005T B-field line above the horizontal center of the top of the magnet. Parameter C is the maximum horizontal width of the 0.005T B-field line, roughly near the vertical center of the magnet.

| FIG. Param | A | B | C | D | E | F |
|---|---|---|---|---|---|---|
| A | 1 | 0.35 | 1.09 | 1.15 | 1.20 | 1.17 |
| B | 1 | 0.85 | 1.03 | 1.04 | 1.06 | 1.05 |
| C | 1 | 0.97 | 1.06 | 1.08 | 1.06 | 1.08 |

Clearly from Table 1, the field in FIG. 13B is degraded for use in a pickup, with only small percentage changes in the field for parameters B & C for FIGS. 13C-F. If one is trying to get the tonality of a P-90 type pickup, for example, parameter A in FIGS. 13E&F looks the best.

Figure 14A:
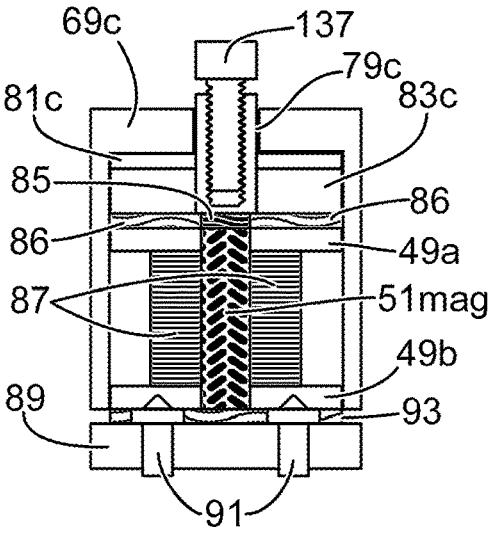
FIGS. 14A&B show the end and side views of a shorter and slightly wider blade pole, drilled and tapped for adjustable screw poles.
Figure 14B:
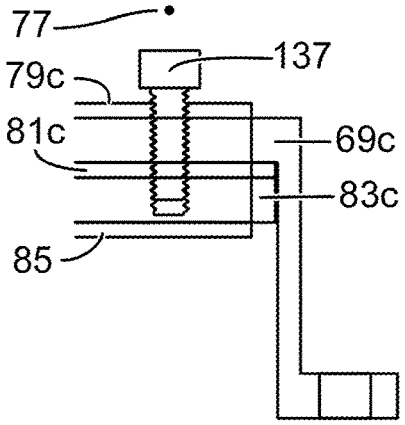
Figure 15A:
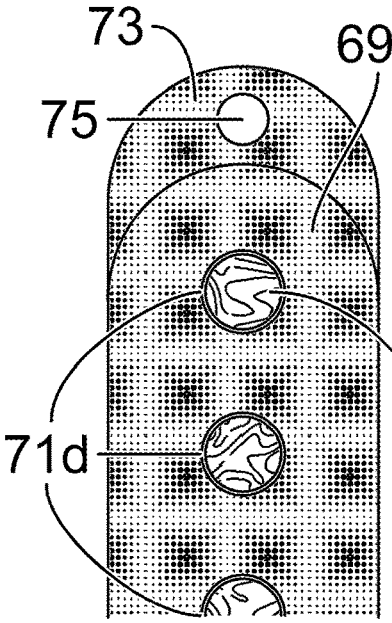
FIGS. 15AB&C show an alternative embodiment in which the pickup cover and blade pole have been modified to simulate standard 5 mm round poles with staggered heights.

FIGS. 14A&B show an alternate embodiment for the blade pole, including adjustable pole screws. FIG. 14A shows a pseudo-cross section of the end view of the pickup with a blade pole modified for adjustable screw poles. Fill patterns and stippling of the components have been left off for clarity. The components 49*a*, 49*b*, 51mag, 85, 86, 87, 89, 91 & 93 are the same as in FIG. 8. The blade pole (79*c*) is now slightly thicker in the shortest dimension, drilled and tapped under a string to accept the adjustable screw pole extension (137), but shorter, so that it rises slightly above the modified pickup housing (69*c*), which has a wider slot to accommodate it. The elastomer pad (81*c*) and blade pole support (83*c*) must also accommodate the slightly wider pole thickness. FIG. 14B shows a pseudo-cross section of the side view, with other components and fill patterns omitted for clarity, with pole screw (137) sitting under the 1-string (77). The other component numbers duplicate FIG. 14A.

In FIGS. 14A&B, the pole screw is shown as a cap screw, which usually has a hex pocket for an Allen-head key, but can be any type of head necessary for the desired tone of the pickup, including an oversized head, much wider than the blade, such as the button heads now showing up in newer pickups. The modified blade (79*c*) sits slightly proud of the modified cover (69*c*) so that screwing the adjustable pole screw (137) all the way down will not put any stress on the other components. In this embodiment, different blade poles can have different screw poles spacings, to fit the poles under the strings exactly in each pickup, merely be replacing the blade pole module. Not even the cover needs to be replaced.

Figures 15B, 15C:
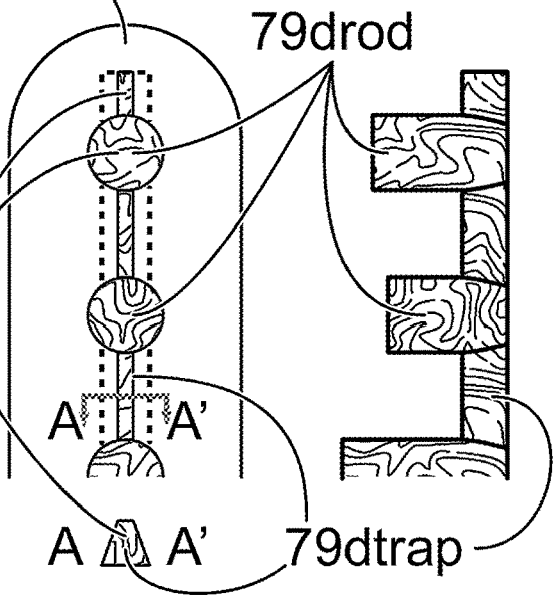

FIGS. 15 AB&C show sections of pickup parts in an alternative embodiment, where the pickup cover and blade pole have been shaped to simulate standard 5 mm round poles with staggered heights. FIG. 15A shows the top view of one end of the modified cover (69*d*), with the usual mounting ear (73) and hole (75), and round holes (71*d*) instead of a rectangular slot, to pass the round pole parts of the blade (79*d*). FIG. 15B shows the top view a section of the blade module, with the modified blade support (83*d*) and the modified blade (79*d*), with trapezoidal sections (79*d*trap, cross-section A-A') connecting the rod sections (79*d*rod). The dotted lines show the position of the bottom of the trapezoidal sections. FIG. 15C shows a side view of the section of the blade pole (without the blade support or elastomer pads), with the staggered heights, and the trapezoidal sections (79trap) connecting the rod sections (79rod).

It is clear from these figures that the rod sections can be either staggered or flat in height, and either solid or drilled and tapped for adjustable screw pole extensions. Further, the rod sections can be any shape desired for a particular tonal effect, including with cup-shaped tops, as in FIGS. 9 & 10, to change the harmonics of the tone. They can be other shapes besides rods, and any spacing to match the strings anywhere from the bridge to the neck. This can all be done by simply changing out the cover, blade pole and upper elastomer pad, leaving the core and base modules as is.

Figure 16A:
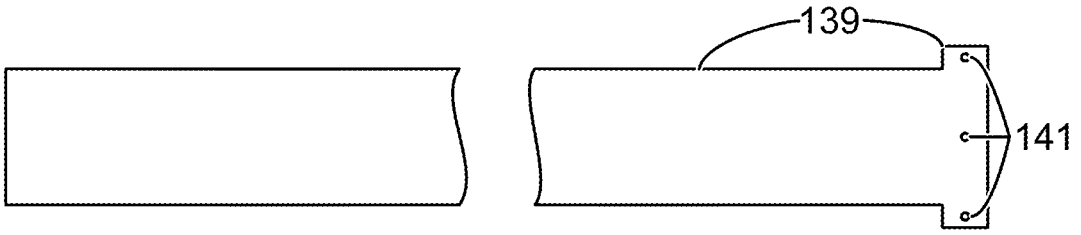
FIGS. 16AB&C show how a flexible circuit (139, 141, 143, 145) can extend the ground interconnect (61*ci*) into a shield wrapped on top of the coil (not shown) underneath the coil flanges (49) and the interconnects (61*ai, bi, ci*), using a comb shield (143, 145).
Figure 16B:
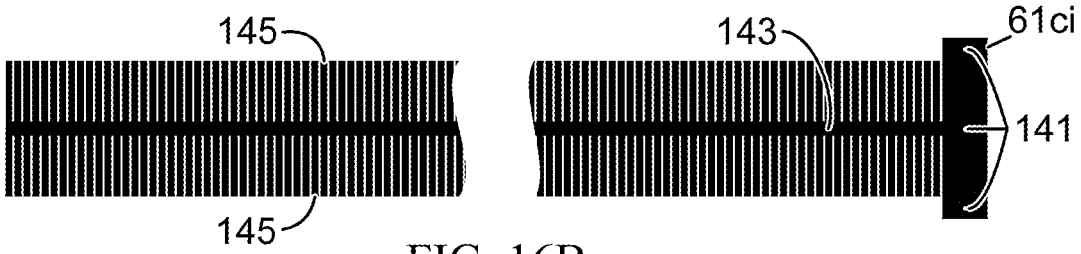
Figure 16C:
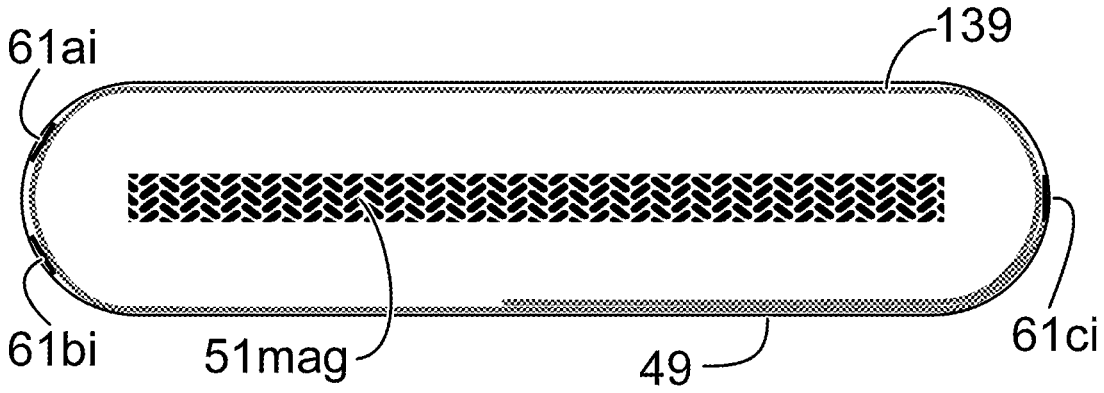

FIGS. 16AB&C show how a flexible printed circuit (139, 141, 143, 145) can extend the ground interconnect (61*ci*) into an electrostatic shield wrapped on top of the coil (not shown) between the coil flanges (49) and the interconnects (61*ai, bi, ci*), using a comb shield (143, 145). FIG. 16A shows the basic shape of the flexible circuit substrate (139) with plated-through holes, or vias (141). FIG. 16B shows the printed circuit plating pattern on the substrate, with the T-bar plated as the ground interconnect (61*ci*), connected to plating on both sides by vias (141), with a conductor down the length (143) connecting the comb teeth (145) of the shield. The shield can be plated on just the one side away from the coil, but the interconnect bar must also be plated on the other side to connect to the plated coil flange notch (57*c*, FIG. 6B) which connects to the ground contact (61*c*) on each flange. To keep from shorting either the coil or the interconnects together, the plating on the shield (139) should be coated with a non-conductive layer everywhere but where the interconnect (61*ci*) connects electrically to the flange electrical ground contact (61*c*, FIG. 6B) in the notch (57*c*, FIG. 6B). FIG. 16C shows how the shield substrate (139, checkered line) is wrapped about the coil (not shown) under the coil form flange (49*a* or *b*). It starts with the ground interconnect (61*ci*) and wraps clockwise around the coil (not shown), under the coil end interconnects (61*ai*, 61*bi*), back under the ground interconnect (61*ci*), and then under itself.

This is the fancy way to do it, with the most likely odds of success. It could also be a much simpler length of copper tape, about the same size and preferably insulated with at least a coat of varnish, wrapped over the coil and under the interconnects, then soldered to the ground interconnect. If the cut ends are also varnished, so that it does not short to itself or anything else, then shorts and hysteresis currents are less likely to develop.

The invention claimed is:

1. A modular electromagnetic string vibration pickup, having a longitudinal horizontal axis and a lateral horizontal axis, placed in a musical instrument having strings wherein said pickup has multiple modules, including a base module, below a core module, a user-modifiable blade pole module, and a cover module, wherein two or more of said modules are manually separable and replaceable, said replaceable modules having elastomer shims placed between them and other adjoining modules, in which said core module is a primary sensing element for string vibration and signals of external noise, said pickup being constructed to maintain humbucking properties of a humbucking circuit with two or more equivalent pickups having similar electric and magnetic properties, regardless of a vertical inversion of said core module;

wherein said core module is constructed:

a. with a wire coil wound around a magnet or magnets, normal to the field of said magnet or magnets, between two plate-like coil forms; and b. wherein:

i. both coil forms having a single design with a printed circuit on a side away from said wire coil; and ii. said printed circuit having two or more separate electrical contacts, which contact index pins of said base module, said contacts distributed upon said coil forms asymmetrically about a vertical axis, and symmetrically about one and only one horizontal axis, said horizontal axis being the axis of rotation for vertically inverting said core module, so that proper mating between said electrical contacts and said index pins in said base module can occur, regardless of which of said coil forms is in contact with said index pins.

2. Said base module as, recited in claim 1, being made of rigid, plate-like material, with ordinary means for mounting said base module mechanically to said musical instrument, with two or more electrically-conducting rod-like index pins, electrically insulated from said base module, with means for electrically connecting said index pins to other musical instrument components not part of said pickup, said index pins being constructed as:

a. a rod-like body extending vertically through and mounted in said base module, above and below it, and b. a flange of greater diameter than said rod-like body, on an upper surface of said base module, with a top plane of said flange connecting electrically to said core module, and c. a protrusion above said flange, tending to the same diameter of said rod-like body, impinging into a mating depression in the said core module; and d. said index pins being distributed asymmetrically about a central vertical axis of said pickup and said base module, and distributed symmetrically about one and only one horizontal axis, said horizontal axis being the axis of rotation when said core module is vertically inverted.

3. Said core module, as recited in claim 1, being a replaceable module, and being constructed:

a. with one or more magnets with a same pole oriented toward said strings;

b. with the coil forms being non-magnetic and electrically non-conductive; and c. wherein:

i. said coil forms each have a central hole into which said one or more magnets pass through; and ii. both coil forms having a single design; and iii. one of said coil forms is designated a first coil form, and the other of said coil forms is designated the second coil form; and iv. said electrical contacts have depressions to mate with upper protrusions of said index pins in said base module and make electrical contact with tops of flanges on said index pins when placed upon them; and d. the ends of said wire coil are mechanically and electrically connected to electrical contacts on the first of said coil forms, the end of said wire coil from an inner winding being a first end, and the end of said wire coil from an outer winding being a second end, said first end of said wire coil being connected through a notch or hole in said first coil form to a first electrical contact on said first coil form, and said second end of said wire coil being connected through a notch or hole in said first coil form to a second contact on said first coil form; and e. wherein each electrical contract has a corresponding electrical interconnect, wherein:

i. said electrical interconnects pass by said wire coil, separated from it by insulating solid material or an air gap; and ii. a first electrical interconnect connects said first electrical contact on said first coil form to a second electrical contact on said second coil form; and iii. a second electrical interconnect connects said second electrical contact on the first coil form to said first electrical contact on said second coil form; and iv. when said printed circuit on said coil forms includes a grounded shield, one or more electrical contacts for grounding said grounded shield are placed symmetrically about said horizontal axis of rotation for vertically inverting said core module, and at least a third electrical interconnect connecting said one or more grounding electrical contacts on said coil forms, with said one or more grounding electrical contacts on said coil forms mating with at least one index pin on said base module, which index pin connects to a ground off said pickup.

4. Said blade pole module, as recited in claim 1, situated generally above said core module and passing through said cover module, which blade pole module transfers the magnetic field of a magnet or magnets in said core module to said strings, with:

a. a vertical plate-like blade part, made of ferro-magnetic material to pass the magnetic field of said magnet or magnets to said strings, said blade part passing through said cover module, said blade part being modifiable by the user of a stringed musical instrument to change a size or shape of an air gap between a top of said blade part and said strings individually and facilitate changing the volume and tonal character of an output of said pickup due to the vibrations of said strings; and b. a horizontal, plate-like base part, made of rigid non-magnetic and electrically non-conducting material, formed around and permanently affixed to said blade part, tending to the same horizontal extent as a top of said core module and an inside of said cover module.

5. Said cover module, as recited in claim 1, made of thin and rigid material, roughly the same shape, size and thickness of construction of a standard single-coil pickup cover, so as to fit in standard pickup holes in common electric guitar pick guards, having top, middle and bottom parts, with a. said top part, horizontal and plate-like, with one or more holes in a top side of said cover module, to pass a blade part of said blade pole module through said cover module to an air gap below said strings; and b. said middle part connecting said top and bottom parts, shaped to hold said core module closely; and c. said bottom part, horizontal and plate-like, comprised of two horizontal ear-like mounting flanges at bottom ends of said middle part as are commonly used in other pickups, with holes for mounting said cover module to said base module, and for mounting said pickup to a musical instrument.

6. Said elastomer shims, as recited in claim 1, one or more in number between said separable and replaceable modules, electrically non-conductive, made to a size and a combination of thickness, vertical compressibility and stiffness such that they compress vertically and fill spaces between said separable and replaceable modules, and against insides of said cover module when said pickup is fully assembled, and which also inhibit horizontal and vertical movements between said separable and replaceable modules, so as to inhibit microphonics when said separable and replaceable modules are fully assembled into said pickup, but when said pickup is disassembled allow said separable and replaceable modules to be removable.

7. Said base module and said cover module as recited in claim 1, wherein said base module and said cover module have horizontal ear-like mounting flanges like unto standard pickups, and said base module has raised areas beyond a horizontal extent of said cover module, cupping said cover module, so as to aid in assembly and maintain a relatively fixed spatial relationship, with threaded holes in said base module and unthreaded holes in said cover module to accommodate standard pickup mounting screws and springs, which springs help to hold said replaceable modules together.

8. Said base module and said cover module as recited in claim 1, wherein said base module and said cover module have horizontal ear-like mounting flanges like unto standard pickups, but larger in horizontal area to include assembly screws passing through plain holes in mounting flanges of said base module, into threaded holes in mounting flanges of said cover module, so as to hold said replaceable modules together independent of mounting screws and springs, with threaded holes in said base module and unthreaded holes in said cover module to accommodate standard mounting screws and springs.

9. Said base module as recited in claim 2, wherein said index pins are elongated and shaped below said base module to form solder connections to circuits and components off said pickup.

10. Said base module as recited in claim 2, wherein said base module is electrically non-conductive and said index pins are connected by conductive circuits printed on a bottom of said base to other components mounted on said base module, including electrical contacts or connectors to other parts of said musical instrument off said pickup.

11. Said base module as recited in claim 2, which is ferro-magnetic material, except wherein said index pins sit in non-conducting cones in said base material with wide bases of said cones up and situated against a bottom of said pin flanges at an upper surface of said base material, with tops of said cone of sufficient size to assure insulation between said index pins and the remainder of said base material.

12. Said base module as recited in claim 11, wherein said base module has one or more horizontal extensions beyond the limits of said cover module in a direction running along instrument strings, so as to widen a magnetic field along the direction in which said strings run.

13. Said base module as recited in claim 12, wherein said one or more horizontal extensions of said base module is bent, beyond a horizontal extent of said cover, away from parallel with said strings, so as to modify interaction of the field of said magnet with said strings.

14. Said base module as recited in claim 2, wherein said index pins connect electrically and mechanically to a separate printed circuit mounted below said base module, which includes connections to other components of said musical instrument off of said pickup.

15. Said blade pole module, as recited in claim 4, wherein said blade part extends only slightly above a top part of said cover module, and is wide enough in its smallest dimension to accommodate threaded holes for ferro-magnetic screws, which when fully lowered by screw action sit near said top part of said cover module, and which adjust manually in height below said strings of said instrument, so as to change the air gap between said blade part and said strings.

16. Said blade pole module, as recited in claim 4, wherein:

a. said ferro-magnetic blade part of said blade pole module has multiple extensions above said base part of said blade pole module, separated horizontally along a length of said blade part, across said strings, with each of said extensions connected together within said base part by rectangular or trapezoidal sections, the bottoms of which are at least the same width across a short dimension as said magnet of said core module; and b. said base part of said blade pole module is molded about said extensions and connecting sections of said blade.

17. Said blade pole module, as recited in claim 16, wherein said extensions are rod-like in horizontal cross-section, one per string, approximating poles of standard pickups, either flat or staggered in height below said strings.

18. Said blade pole module, as recited in claim 17, wherein said rod-like extensions rise barely above said cover module and are threaded vertically in their centers to accept ferro-magnetic screws, which adjust manually to change gaps below said strings, like unto adjustable poles on standard pickups.

19. Said blade pole module, as recited in claim 4, wherein said blade part is constructed of a soft enough ferro-magnetic material so that said blade part may be manually re-shaped by the user to any desired height or shape under said strings of said instrument, so as to change the tone or volume of the vibrations signals of each of said strings in the output of said pickup.

20. Two complimentary versions of said core module as recited in claim 3, wherein:

a. a first version has its North magnetic pole towards said strings, and a second version has its South magnetic pole towards said strings; and b. said wire ends of said wire coil on each version are connected to only a bottom coil form to said base module on both versions, and are connected to circuits off said pickup so as to maintain humbucking circuits no matter which version is used; and c. when said printed circuit on an upper coil form has said grounded shield, only said electrical interconnect for said grounded shield exists in said core module.

* * * * *